US010452011B2

(12) United States Patent
Suzuki et al.

(10) Patent No.: US 10,452,011 B2
(45) Date of Patent: Oct. 22, 2019

(54) FIXING DEVICE AND IMAGE FORMING APPARATUS INCLUDING THE SAME

(71) Applicant: HP PRINTING KOREA CO., LTD., Suwon (KR)

(72) Inventors: Yasuo Suzuki, Yokohamashi (JP); Takayuki Yamada, Yokohamashi (JP)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 16/016,045

(22) Filed: Jun. 22, 2018

(65) Prior Publication Data

US 2018/0299808 A1 Oct. 18, 2018

Related U.S. Application Data

(63) Continuation of application No. 15/297,666, filed on Oct. 19, 2016, now Pat. No. 10,031,452.

(30) Foreign Application Priority Data

Dec. 22, 2015 (JP) ..... 2015-249896
Jul. 19, 2016 (KR) ..... 10-2016-0091446

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
None
See application file for complete search history.

(56) References Cited

U.S. PATENT DOCUMENTS 5,499,087 A * 3/1996 Hiraoka ..... G03G 15/2064 219/216
8,655,211 B2 2/2014 Fujimoto et al.
10,031,452 B2 * 7/2018 Suzuki ..... G03G 15/2053
2006/0083567 A1 * 4/2006 Ito ..... G03G 15/206 399/400
2011/0236089 A1 9/2011 Tanaka et al.
2012/0275830 A1 11/2012 Suzuki et al.
2014/0294465 A1 10/2014 Hazeyama et al.
2015/0093167 A1 4/2015 Hazeyama
(Continued)

FOREIGN PATENT DOCUMENTS

JP 2001-42670 A 2/2001
JP 2002-023534 A 1/2002
(Continued)

*Primary Examiner* — Clayton E. LaBalle
*Assistant Examiner* — Jas A Sanghera
(74) *Attorney, Agent, or Firm* — Staas & Halsey LLP

(57) ABSTRACT

Provided is a fixing device for preventing an increase in torque when a fixing belt starts to be driven. The fixing device may include a fixing belt that is rotatable; a pressure roller configured to pressure-contact an outer circumferential surface of the fixing belt and to form a fixing nip portion between the pressure roller and the fixing belt. A contact member is located inside the fixing belt and includes a contact portion that contacts an inner circumferential surface of the fixing belt. The contact portion includes a surface having a plate shape that faces the pressure roller and a plurality of protrusions that protrude from the surface toward the pressure roller.

19 Claims, 16 Drawing Sheets

(56) References Cited

U.S. PATENT DOCUMENTS

| | | | |
|---|---|---|---|
| 2015/0098737 | A1 | 4/2015 | Matsumoto |
| 2017/0097598 | A1 | 4/2017 | Kudo |

FOREIGN PATENT DOCUMENTS

| | | | |
|---|---|---|---|
| JP | 2002-299007 | A | 10/2002 |
| JP | 2004-029394 | | 1/2004 |
| JP | 2004-037552 | A | 2/2004 |
| JP | 2005-077847 | A | 3/2005 |
| JP | 2006-047769 | A | 2/2006 |
| JP | 2007-114698 | A | 5/2007 |
| JP | 2009-229494 | A | 3/2008 |
| JP | 2009-15227 | A | 1/2009 |
| JP | 4543670 | B2 | 7/2010 |
| JP | 4683156 | B2 | 2/2011 |
| JP | 2012-181421 | A | 3/2011 |
| JP | 2012-103424 | | 5/2012 |
| JP | 2012-198516 | A | 10/2012 |
| JP | 2013-134422 | A | 7/2013 |
| JP | 2013-148837 | A | 8/2013 |
| JP | 2013-171171 | A | 9/2013 |
| JP | 2013-195908 | A | 9/2013 |
| JP | 2014-139641 | A | 7/2014 |

* cited by examiner

FIXING DEVICE AND IMAGE FORMING APPARATUS INCLUDING THE SAME

CROSS-REFERENCE TO RELATED APPLICATION

This application is a continuation application of U.S. patent application Ser. No. 15/297,666, filed Oct. 19, 2016, which claims the benefit of Japan Patent Application No. 2015-249896, filed on Dec. 22, 2015, in the Japan Patent Office, and Korean Patent Application No. 10-2016-0091446, filed on Jul. 19, 2016, in the Korean Intellectual Property Office, the disclosure of which is incorporated herein in its entirety by reference.

BACKGROUND

1. Description of the Related Art

In an image forming apparatus, a recording medium fed from a feeding unit is fed to a transfer unit and a toner image formed on the transfer unit is secondarily transferred to the recording medium. After the toner image is transferred to the recording medium, toner disposed on the recording medium is melted and fixed by a fixing unit (e.g., fixing device). The recording medium onto which the toner is fixed is discharged from a discharging unit that is located at a downstream.

A conventional fixing device, for example, a fixing device included in an image forming apparatus of Patent Document 1, is formed by using a belt-nip method and includes an endless fixing belt and an elastic roller (e.g., a pressure roller) that are one pair of members for forming a nip portion. The fixing device may include a fixing member disposed on an inner circumferential surface of the fixing belt, and a load of the elastic roller may be applied to the fixing member.

[Patent Document 1] Japanese Patent Application Publication No. 2001-42670

However, according to a conventional technology disclosed in Patent Document 1, when the fixing device is not used for a long time or is re-used a predetermined period of time after the use of the fixing device has been stopped, since the fixing belt and the fixing member closely contact each other, a torque needed to drive the fixing belt may be increased.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
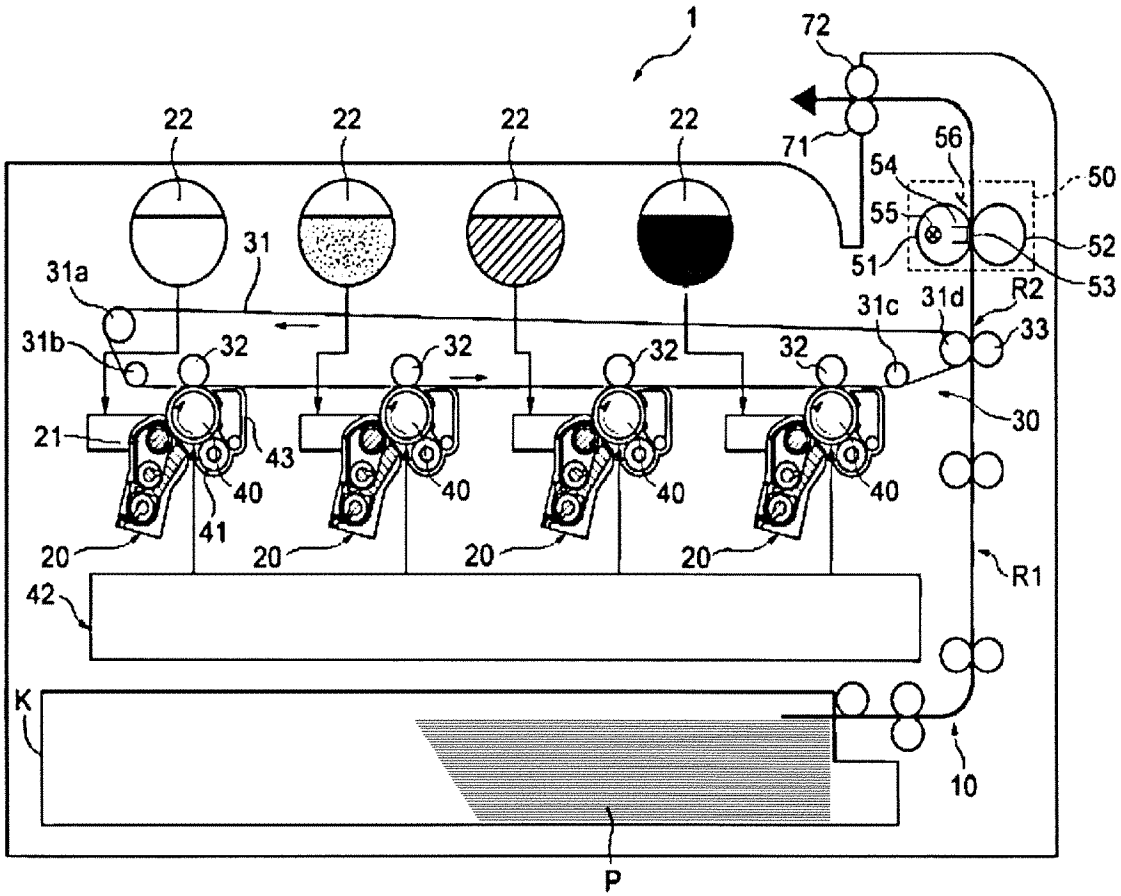
FIG. 1 is a view of an image forming apparatus including a fixing device according to an embodiment.

Reference will now be made in detail to embodiments, examples of which are illustrated in the accompanying drawings. In the drawings, the same elements or portions are denoted by the same reference numerals, and a repeated explanation thereof will not be given.

An image forming apparatus 1 according to an embodiment may form a color image by using magenta, yellow, cyan, and black colors. As shown in FIG. 1, the image forming apparatus 1 according to an embodiment may include a recording medium feeding unit 10 that feeds a recording medium P, a developing device 20 that develops an electrostatic latent image, a transfer unit 30 that secondarily transfers a toner image to the recording medium P, a photosensitive drum 40 that is an electrostatic latent image bearing member having a circumferential surface on which an image is formed, and a fixing device 50 that fixes the toner image onto the recording medium P.

The recording medium feeding unit 10 may receive the recording medium P on which the image is finally recorded and may feed the recording medium P to a feeding path R1. In this case, a plurality of the recording media P may be stacked and stored in a cassette K. The recording medium feeding unit 10 may feed the recording medium P to a secondary transfer region R2 at a time when the toner image transferred to the recording medium reaches the secondary transfer region R2.

Four developing devices 20 may be arranged according to colors. Each of the developing devices 20 may include a developer roller 21 that presses the toner against the photosensitive drum 40. The developing device 20 sufficiently charges the toner by mixing the toner with carrier particles and presses a developing agent produced due to the mixture of the toner and the carrier particles against the developer roller 21. Next, when the developing agent is carried to a region that faces the photosensitive drum 40 due to rotation of the developer roller 21, the toner of the developing agent pressed by the developer roller 21 moves to the electrostatic latent image formed on the circumferential surface of the photosensitive drum 40 to develop the electrostatic latent image.

In order to secondarily transfer the toner image formed by the developing device 20 to the recording medium P, the transfer unit 30 may be fed to the secondary transfer region R2. The transfer unit 30 may include a transfer belt 31, rotating rollers 31*a*, 31*b*, 31*c*, and 31*d* that rotate the transfer belt 31, a primary transfer roller 32 that allows the transfer belt 31 to be held between the primary transfer roller 32 and the photosensitive drum 40, and a secondary transfer roller 33 that allows the transfer belt 31 to be held between the secondary transfer roller 33 and the rotating roller 31*d*.

The transfer belt 31 is an endless belt that is rotated by the rotating rollers 31*a*, 31*b*, 31*c*, and 31*d*. The primary transfer roller 32 may be disposed to apply a pressure from an inner circumference of the transfer belt 31 to the photosensitive drum 40. The secondary transfer roller 33 may be disposed to apply a pressure from an outer circumference of the transfer belt 31 to the rotating roller 31*d*.

The photosensitive drum 40 is an electrostatic latent image bearing member having a circumferential surface on which an image is formed. In the image forming apparatus 1 for forming a color image according to an embodiment, four photosensitive drums 40 corresponding to, for example, magenta, yellow, cyan, and black colors, may be arranged in a direction (referred to as a movement direction) in which the transfer belt 21 moves. The developing device 20, a charge roller 41, an exposure unit 42, and a cleaning unit 43 may be arranged around each of the photosensitive drums 40 as shown in FIG. 1.

The charge roller 41 may uniformly charge a surface of the photosensitive drum 40 by using a predetermined potential. The exposure unit 42 may expose to light the surface of the photosensitive drum 40 charged by the charge roller 41, and in this case, the surface of the photosensitive drum 40 may be exposed to light to correspond to an image to be formed on paper that is the recording medium P. Accordingly, a potential of a portion of the surface of the photosensitive drum 40 that is exposed to light by the exposure unit 42 may be changed, and thus the electrostatic latent image may be formed. Four developing devices 20 may receive the toner from toner tanks 22 that are arranged to respectively correspond to the four developing devices 20, may develop the electrostatic latent images formed on the photosensitive drums 40 by using the toner supplied from the toner tanks 22, and may generate the toner images. For example, magenta, yellow, cyan, and black toner may be respectively filled in the four toner tanks 22. The cleaning unit 43 may retrieve the toner remaining on each of the photosensitive drums 40 after the toner image formed on the photosensitive drum 40 is primarily transferred to the transfer belt 31.

The fixing device 50 may attach and fix the toner image secondarily transferred to the recording medium P from the transfer belt 31 onto the recording medium P. The fixing device 50 according to an embodiment may include, for example, a fixing belt 51 that heats the recording medium P and a pressure roller (e.g., an elastic roller) 52 that applies a pressure to the fixing belt 51. The fixing belt 51 and the pressure roller 52 may be formed to have cylindrical shapes. A fixing nip portion 53 that is a contact portion may be formed between the fixing belt 51 and the pressure roller 52, and the toner image may be melted and fixed onto the recording medium P as the recording medium P passes through the fixing nip portion 53 in a feeding direction.

Also, the image forming apparatus 1 according to an embodiment may further include discharge rollers 71 and 72 that discharge the recording medium P onto which the toner image is fixed by the fixing device 50 to the outside of the image forming apparatus 1.

An operation of the image forming apparatus 1 will now be explained. When an image signal of an image to be recorded is input to the image forming apparatus 1, a controller of the image forming device 1 may uniformly charge a surface of the photosensitive drum 40 to a predetermined potential by using the charge roller 41 according to the received image signal.

Next, an electrostatic latent image may be formed by emitting a laser beam to the surface of the photosensitive drum 40 by using the exposure unit 42.

A toner image may be formed when the developing device 20 develops the electrostatic latent image. The toner image is primarily transferred from the photosensitive drum 40 to the transfer belt 31 when the photosensitive drum 40 and the transfer belt 31 face each other. The toner images formed on the four photosensitive drums 40 may be sequentially stacked on the transfer belt 31 to form one stacked toner image.

Next, the staked toner image may be fed to the secondary transfer region R2 where the rotating roller 31*d* and the secondary transfer roller 33 face each other, and may be secondarily transferred to the recording medium P that is fed from the recording medium feeding unit 10 in the secondary transfer region R2.

The recording medium P to which the stacked toner image is secondarily transferred may be fed to the fixing device 50. The stacked toner image may be melted and fixed onto the recording medium P by applying heat and a pressure to the recording medium P when the recording medium P passes between the fixing belt 51 and the pressure roller 52.

Next, the recording medium P may be discharged to the outside of the image forming apparatus 1 by the discharge rollers 71 and 72.

The fixing device 50 will now be explained in more detail with reference to FIG. 2.

Figure 2:
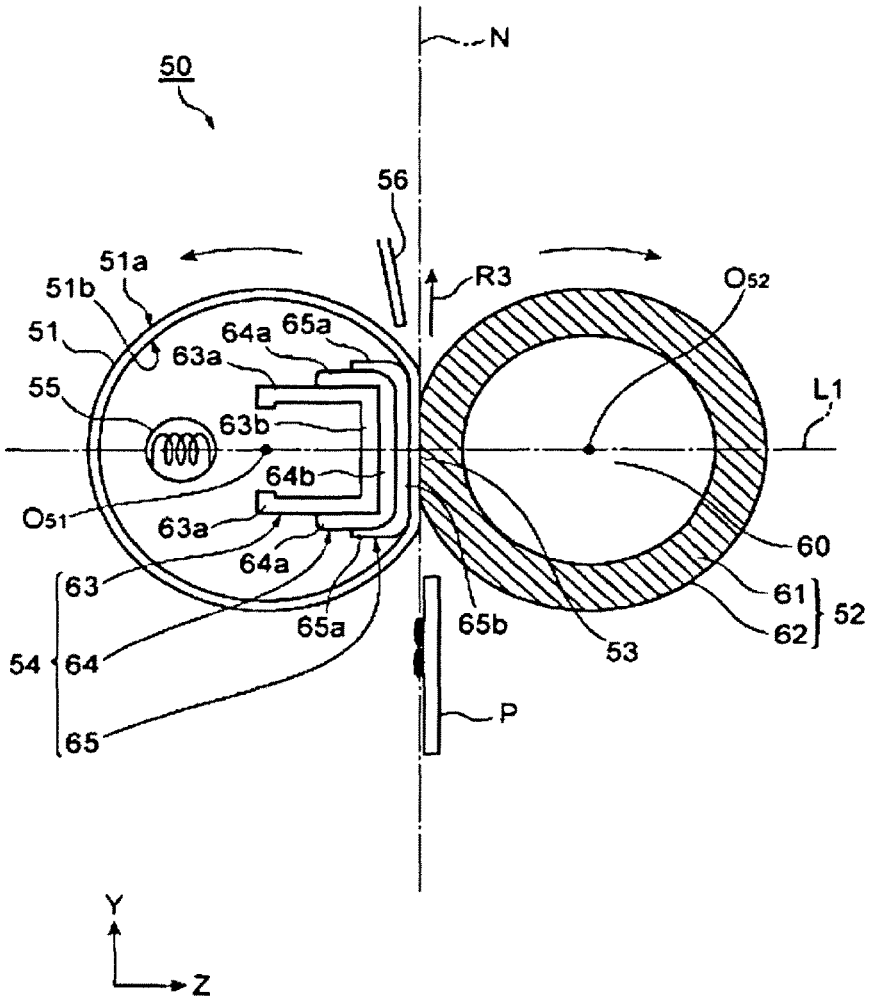
FIG. 2 is a cross-sectional view of the fixing device using a belt-nip method according to an embodiment.

As shown in FIG. 2, the fixing device 50 may include the fixing belt 51, the pressure roller 52, a contact member (e.g., a fixing member) 54, and a heat source (e.g., a heater) 55. Also, the fixing device 50 may include a separation member 56 that separates the recording medium P attached to an outer circumferential surface 51*a* of the fixing belt 51 from the fixing belt 51. The separation member 56 may be disposed in a feeding direction R3 of the recording medium P, and may be disposed at an outlet of the fixing nip portion 53 through which the fixing belt 51 is discharged.

Figure 3:
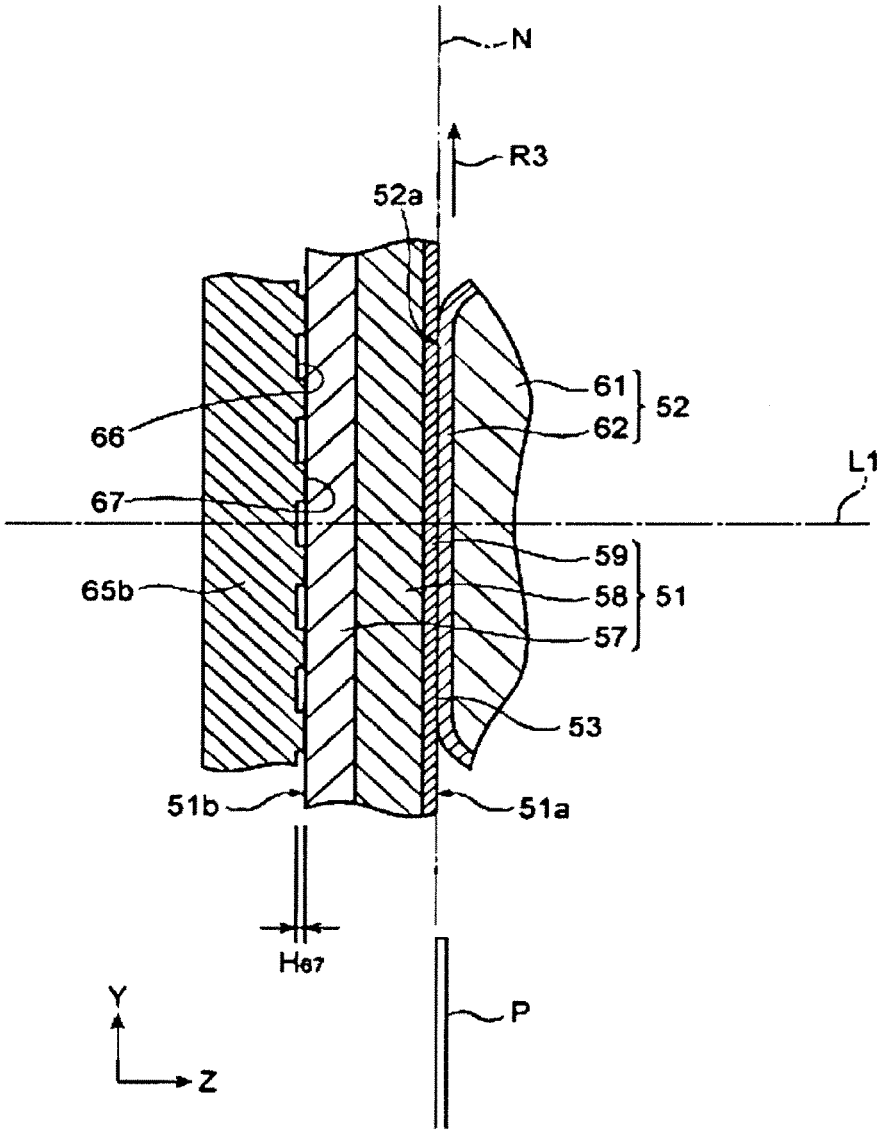
FIG. 3 is an enlarged cross-sectional view of a fixing nip portion according to an embodiment.

The fixing nip portion 53 is a portion at which the recording medium P is held between the fixing belt 51 and the pressure roller 52 as shown in FIGS. 2 and 3. The fixing nip portion 53 may include a portion (e.g., a contact portion) that is the closest to the outer circumferential surface 51*a* of the fixing belt 51 and an outer circumferential surface 52*a* of the pressure roller 52. In general, an internal pressure of the fixing nip portion 53 may be equal to or greater than 0.049 MPa and equal to or less than 0.196 MPa (for example, equal to or greater than 0.5 $kgf/cm^2$ and equal to or less than 2.0 $kgf/cm^2$). The internal pressure of the fixing nip portion 53 is a pressure applied to the recording medium P that is held between the fixing belt 51 and the pressure roller 52.

The fixing belt 51 may be a flexible rotating body having a cylindrical shape and may include, for example, a metal. Examples of the metal that may be included in the fixing belt 51 may include stainless. Also, the fixing belt 51 may include, for example, a synthetic resin.

The fixing belt 51 may include a plurality of materials that are stacked as shown in FIG. 3. The fixing belt 51 may include a base portion 57, an elastic layer 58 stacked on the base portion 57, and a surface layer 59 stacked on the elastic layer 58. The base portion 57 may include a metal material such as stainless or nickel. Also, the base portion 57 may include a synthetic resin such as polyimide (PI), polyamide-imide (PAI), polyether ether ketone (PEEK), or liquid crystal polymer (LCP).

The elastic layer 58 may include, for example, rubber. The surface layer 59 may include a fluorine synthetic resin. For example, the fluorine synthetic resin may be at least one selected from among polytetrafluoroethylene (PTFE), perfluoroalkoxy (PFA) fluorine synthetic resin, and a modifier thereof. A thickness of the base portion 57 may be, for example, equal to or greater than 20 μm and equal to or less than 120 μm. A thickness of the elastic layer 58 may be, for example, equal to or greater than 100 μm and equal to or less than 400 μm. A thickness of the surface layer 59 may be, for example, equal to or greater than 10 μm and equal to or less than 50 μm.

The pressure roller 52 may be an elastic rotating body having a cylindrical shape and may include, for example, rubber (e.g., an elastic material). The pressure roller 52 may include an elastic layer 61 that includes an elastic material and a surface layer 62 that is formed on the elastic layer 61. Also, a rotating shaft 60 may be disposed to be inserted into and pass through the pressure roller 52.

The contact member 54 may be disposed inside the fixing belt 51 and may apply a pressure to the fixing belt 51 along with the pressure roller 52. An elastic force may be applied to the contact member 54 by using, for example, a spring member (not shown), and the contact member 54 may be pressed towards the pressure roller 52 due to the elastic force. However, embodiments are not limited thereto, and an elastic force may be applied to the pressure roller 52 and the pressure roller 52 may be pressed towards the contact member 54. Alternatively, at the same time as an elastic force may be applied to the pressure roller 52 and the pressure roller 52 may be pressed towards the contact member 54, an elastic force may be applied to the contact member 54 and the contact member 54 may be pressed towards the pressure roller 52.

The contact member 54 may extend along a rotational axis of the fixing belt 51 having a cylindrical shape, and may include a structure 63 that is disposed inside the fixing belt 51, a support 64 that is fixed to the structure 63, and a fixed sliding member 65 that is supported by the support 64.

Cross-sections of the structure 63, the support 64, and the fixed sliding member 65 taken in a direction perpendicular to a longitudinal direction thereof may have, for example, ⊏ shapes. The structure 63 may include one pair of side walls 63*a* that extend in a direction perpendicular to the feeding direction R3 of the recording medium P and a main body portion 63*b* that connects ends of the one pair of side walls 63*a*. The main body portion 63*b* of the structure 63 may have a plate shape, and a thickness direction of the main body portion 63*b* may be a direction in which a straight line L1 that connects a center of rotation $O_{51}$ of the fixing belt 51 and a center of rotation $P_{52}$ of the pressure roller 52 extends.

The support 64 may include one pair of side walls 64*a* that extend in the direction perpendicular to the feeding direction R3 of the recording medium P and a main body portion 64*b* that connects ends of the one pair of side walls 64*a*. The main body portion 64*b* of the support 64 may have a plate shape, and a thickness direction of the main body portion 64*b* may be a direction in which the straight line L1 extends. The support 64 may be mounted on the structure 63 to be supported by the structure 63, and may be disposed to cover a portion of the structure 63 that is close to the pressure roller 52. For example, the main body portion 64*b* of the support 64 may cover the main body portion 63*b* of the structure 63, and the one pair of side walls 64*a* of the support 64 may cover the one pair of side walls 63*a* of the structure 63.

The fixed sliding member 65 may include one pair of side walls 65*a* that extend in the direction perpendicular to the feeding direction R3 of the recording medium P, and a main body portion (e.g., a contact portion) 65*b* that connects ends of the one pair of side walls 65*a*. The main body portion 65*b* of the fixed sliding member 65 may have a plate shape, and a thickness direction of the main body portion 65*b* may be a direction in which the straight line L1 extends. The fixed sliding member 65 may be mounted on the support 64 to be supported by the support 64, and may be disposed to cover a portion of the support 64 that is close to the pressure roller 52. The main body portion 65*b* of the fixed sliding member 65 may cover the main body portion 64*b* of the support 64, and the one pair of side walls 65*a* of the fixed sliding member 65 may cover the one pair of side walls 64*a* of the support 64.

The fixed sliding member 65 may include a base portion and a surface layer that is formed on the base portion. The base portion of the fixed sliding member 65 may include a metal material such as aluminum or stainless. Also, the fixed sliding member 65 may include a synthetic resin having heat resistance such as LCP or polyphenylene sulfide (PPS).

Also, a fluorine synthetic resin may be applied to a surface of the main body portion 65*b* of the fixed sliding member 65. The fluorine synthetic resin may be at least one selected from among PTFE, PFA fluorine synthetic resin, and a modifier thereof.

The main body portion 65*b* of the fixed sliding member 65 included in the contact member 54 is a contact portion that contacts an inner circumferential surface 51*b* of the fixing belt 51 as shown in FIG. 3. The pressure roller 52 may receive power from a driving motor (not shown) and may rotate about a predetermined rotational axis. The outer circumferential surface 52*a* of the pressure roller 52 may be disposed at the fixing nip portion 53 to contact the outer circumferential surface 51*a* of the fixing belt 51, and thus a rotational force of the pressure roller 52 may be transmitted to the fixing belt 51 and the fixing belt 51 may also rotate about a predetermined rotational axis.

At the fixing nip portion 53, the fixing belt 51 may receive a pressure from the pressure roller 52 and may slide while contacting the main body portion 65*b* of the fixed sliding member 65. The fixing belt 51 may form a plane along the main body portion 65*b* of the fixed sliding member 65 at the fixing nip portion 53 to correspond to the plate shape of the main body portion 65*b*. At the fixing nip portion 53, a movement direction Y of the fixing belt 51 may be the same as the feeding direction R3 of the recording medium P. A nip surface N of the fixing nip portion 53 is a virtual surface set between the fixing belt 51 and the pressure roller 52.

Figure 4:
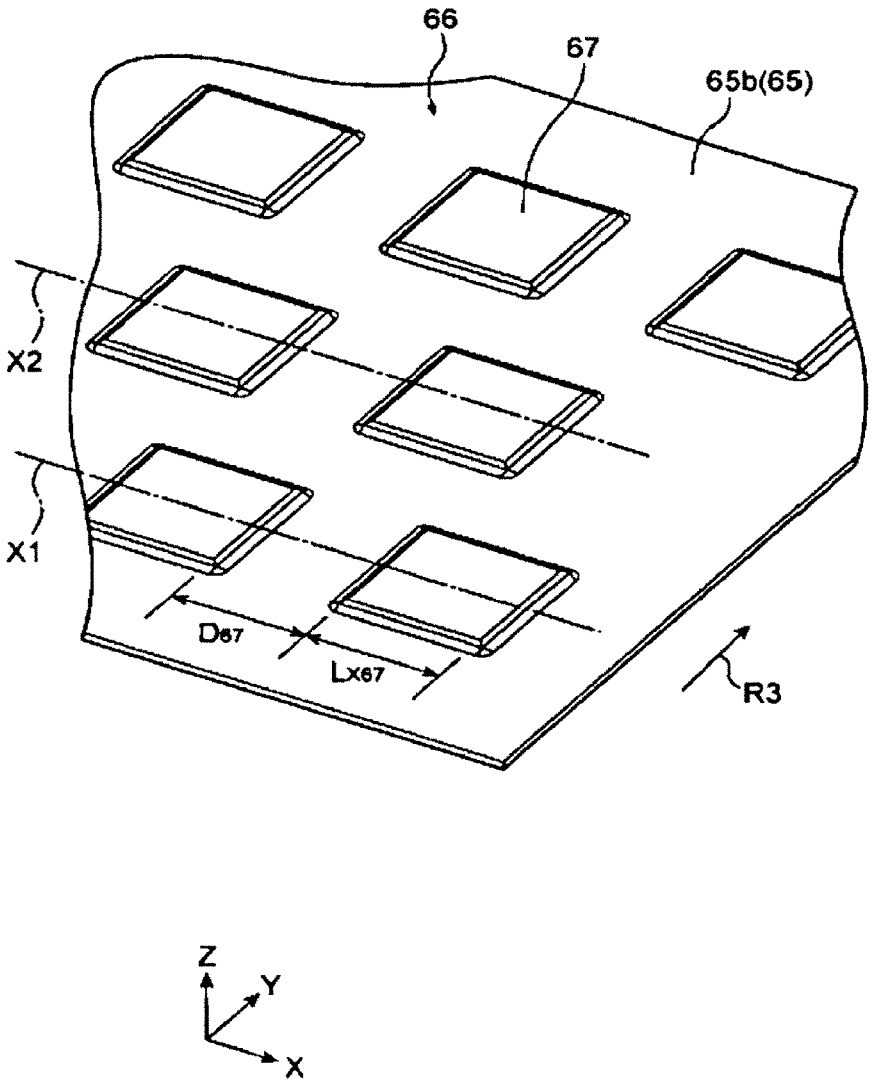
FIG. 4 is an enlarged perspective view of a contact portion of a contact member according to an embodiment.
Figure 5A:
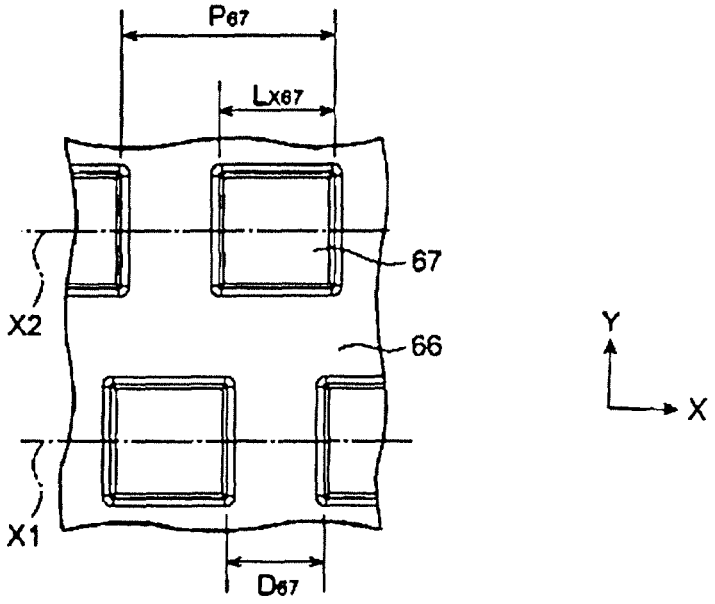
FIGS. 5A through 5C are enlarged plan views of protrusions of the contact portion according to an embodiment.

A plurality of protrusions 67 that protrude from a reference surface 66 toward the pressure roller 52 may be disposed on the main body portion 65*b* of the fixed sliding member 65 as shown in FIGS. 3, 4, and 5A. The reference surface 66 that is a surface of the main body portion 65*b* that faces the pressure roller 52 may be, for example, perpendicular to the straight line L1. The plurality of protrusions 67 may have, for example, rectangular shapes in plan view and may have, for example, the same size and the same shape.

At the fixing nip portion 53, a length $L_{X67}$ of each of the protrusions 67 in a width direction X of the fixing belt 51 that is perpendicular to the movement direction Y of the fixing belt 51 may be equal to or greater than, for example, 0.55 mm. Also, a pitch (e.g., an interval) between the protrusions 67 in the width direction X may be equal to or greater than, for example, 1.1 mm.

Also, the plurality of protrusions 67 may be arranged at regular intervals in parallel in the width direction X to form a plurality of rows (e.g., a first row X1 and a second row X2). Also, the plurality of protrusions 67 arranged to include rows in the width direction X may be arranged at regular intervals in the movement direction Y. For example, the protrusions 67 of the second row X2 may be arranged at positions corresponding to spaces between the plurality of protrusions 67 of the first row X1. Accordingly, the plurality of protrusions of the first row X1 and the second row X2 may be alternately arranged in the movement direction Y of the fixing belt 51 at the fixing nip portion 53. In this case, the length $L_{X67}$ of each of the protrusions 67 may be greater than a distance $D_{67}$ between the protrusions 67.

One or more protrusions 67 may be arranged in the movement direction Y of the fixing belt 51. For example, when the plurality of protrusions 67 are viewed in the movement direction Y of the fixing belt 51, the protrusions 67 may be arranged without any gaps over the entire width in the width direction X. That is, the main body portion 65*b* may contact with the fixing belt 51 in the entire longitudinal direction of the main body portion 65*b* in the feeding direction R3 of the recording medium P. Accordingly, in a longitudinal direction of the fixed sliding member 65, a load of the pressure roller 52 may be uniformized and a portion of the fixing nip portion 53 to which no load is applied may be prevented.

A height $H_{67}$ of each of the plurality of protrusions 67 may be, for example, equal to or greater than 5 μm and equal to or less than 30 μm. The height $H_{67}$ of each of the plurality of protrusions 67 is a height difference between the reference surface 66 and a top surface of the protrusion 67.

When the fixed sliding member 65 including the plurality of protrusions 67 includes a metal material, the plurality of protrusions 67 may be formed by using, for example, press working, etching, or laser engraving. Also, when the fixed sliding member 65 including the plurality of protrusions 67 includes a synthetic resin material, the plurality of protrusions 67 may be formed by using, for example, injection molding, etching, or laser engraving. The protrusions 67 may be formed by eroding a surface of a material by using a chemical, performing etching, and performing wrinkling on a surface of the contact portion. Also, the plurality of protrusions 67 may be formed by performing etching on a surface of the contact portion to have a geometric shape.

Also, when the plurality of protrusions 67 are formed by using laser engraving, a laser engraving machine for emitting a laser beam in a plurality of directions may be used. Accordingly, the plurality of protrusions 67 having complex shapes may be formed.

Also, when the base portion of the fixed sliding member 65 includes an aluminum plate material and a thickness of the base portion is, for example, equal to or greater than 0.2 mm and equal to or less than 0.5 mm, spring back which may occur when press working is performed may be prevented. Accordingly, the plurality of protrusions 67 may be more accurately formed.

Also, when the base portion of the fixed sliding member 65 includes a stainless plate material and a thickness of the base portion is, for example, equal to or greater than 0.1 mm and equal to or less than 0.3 mm, spring back which may occur when press working is performed may be prevented. Accordingly, the plurality of protrusions 67 may be more accurately formed.

Since the plurality of protrusions 67 that protrude from the reference surface 66 are disposed on the main body portion 65*b* of the fixed sliding member 65 included in the fixing device 50 according to an embodiment, a contact area that may be formed between the inner circumferential surface 51*b* of the fixing belt 51 and the main body portion 65*b* of the fixed sliding member 65 may be reduced. Accordingly, an increase in torque which may occur when the fixing belt 51 starts to be driven may be prevented. Also, since friction between the fixed sliding member 65 and the fixing belt 51 is reduced, energy consumption which may occur when the fixing belt 51 is driven may be prevented. Also, sliding resistance may be reduced without placing another member such as a sliding sheet between the fixed sliding member 65 and the inner circumferential surface 51*b* of the fixing belt 51. Accordingly, the fixing device 50 may be simplified, manufacturing costs may be reduced, and an increase in torque which may occur when the fixing belt 51 starts to be driven may be prevented. Also, since the plurality of protrusions 67 that protrude from the reference surface 66 are disposed on the main body portion 65*b* of the fixed sliding member 65, a lubricant may be distributed over the reference surface 66 (e.g., a non-contact portion) disposed around the plurality of protrusions 67, that is, in spaces between the plurality of protrusions 67. Accordingly, the fixing belt 51 may more easily slide, the degradation of the fixing belt 51 as time passes may be reduced, and the quality of the fixing device 50 may be maintained for a long time. Also, a length of each of the protrusions 67 contacting the inner circumferential surface 51*b* of the fixing belt 51 in the width direction X may be equal to or greater than 0.55 mm. Also, a pitch $P_{67}$ between adjacent protrusions of the plurality of protrusions 67 may be equal to or greater than 1.1 mm. Since the plurality of protrusions 67 are included in the fixing device 50 according to an embodiment as described above, contact power between the fixing belt 51 and the fixed sliding member 65 may be reduced, and thus an increase in torque which may occur when the fixing belt 51 is driven may be prevented. Also, since the fixed sliding member 65 is used, a load applied by the pressure roller 52 in a state where the fixing belt 51 is driven may be uniformized and a portion of the fixing nip portion 53 to which no load is applied may be prevented. Also, when the plurality of protrusions 67 are included in the fixing device 50, an internal pressure of the fixing nip portion 53 may be equal to or less than 0.098 MPa.

Figure 5B:
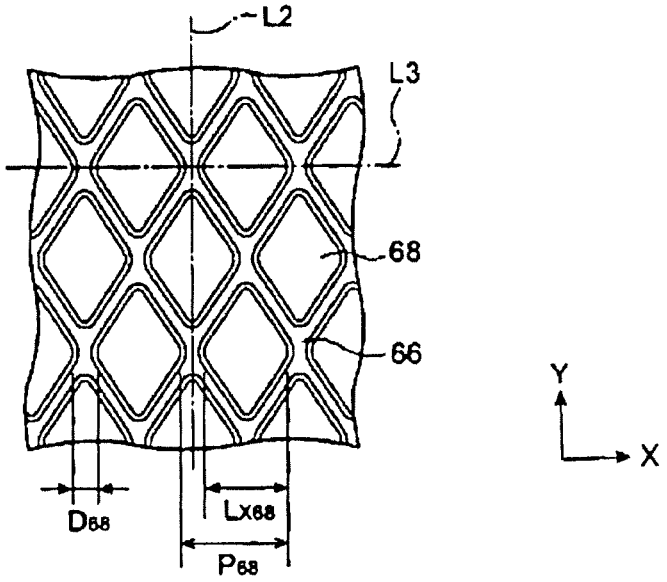

A first modification of protrusions will now be explained with reference to FIG. 5B. Protrusions are not limited to rectangular shapes, and may be protrusions 68 having diamond shapes in plan view.

Diagonal lines L2 that are longer ones from among diagonal lines of the protrusions 68 having diamond shapes may be arranged to travel, for example, in the movement direction Y of the fixing belt 51. Diagonal lines L3 that are shorter ones from among the diagonal lines of the protrusions 68 may be arranged to travel, for example, in the width direction X of the fixing belt 51.

A length $L_{X68}$ of each of the protrusions 68 in the width direction X of the fixing belt 51 that is perpendicular to the movement direction Y of the fixing belt 51 may be, for example, equal to or greater than 0.55 mm. Also, a pitch $P_{68}$ between adjacent protrusions of the protrusions 68 in the width direction X of the fixing belt may be, for example, equal to or greater than 1.1 mm. Also, the length $L_{X68}$ of the protrusion 68 may be greater than a distance $D_{68}$ between the protrusions 68.

Figure 5C:
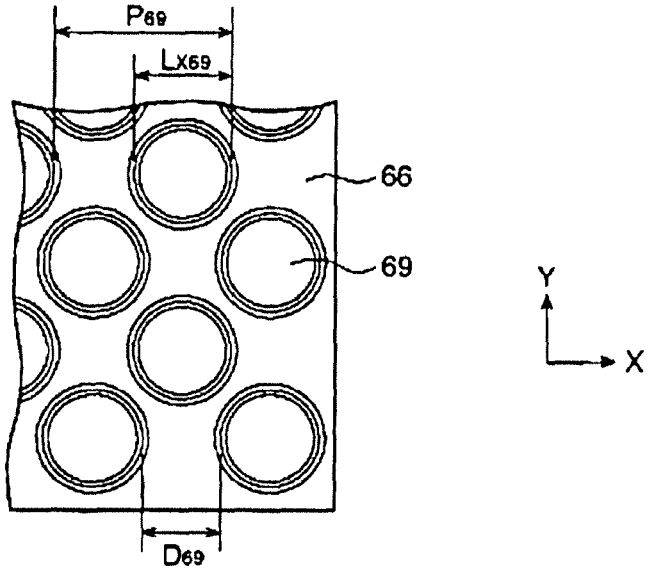

A second modification of protrusions will now be explained with reference to FIG. 5C. Protrusions 69 according to the second modification may have circular shapes in plan view.

The plurality of protrusions 69 may be arranged in parallel in the width direction X (e.g., a first direction) of the fixing belt 51 to form rows, and the plurality of protrusions 69 arranged to form the rows in the width direction X may form a plurality of rows in the movement direction Y (e.g., a second direction) of the fixing belt 51. Also, the plurality of protrusions 69 of adjacent rows in the width direction X of the fixing belt 51 may be arranged not to correspond to each other in the width direction X of the fixing belt 51. The plurality of protrusions 69 may be arranged in a matrix.

Also, directions in which the protrusions 69 form rows are not limited to the width direction X of the fixing belt 51 and the movement direction Y of the fixing belt 51, and may be other directions. Also, the first direction and the second direction may be perpendicular to each other or may intersect at a predetermined angle, instead of 90°.

A diameter $L_{X69}$ of each of the protrusions 69 may be, for example, equal to or greater than 0.55 mm. Also, a pitch $P_{69}$ between adjacent protrusions of the protrusions 69 in the width direction X may be, for example, equal to or greater than 1.1 mm. Also, the diameter $L_{X69}$ of the protrusion 69 may be greater than a distance D69 between the protrusions 69.

Figure 6:
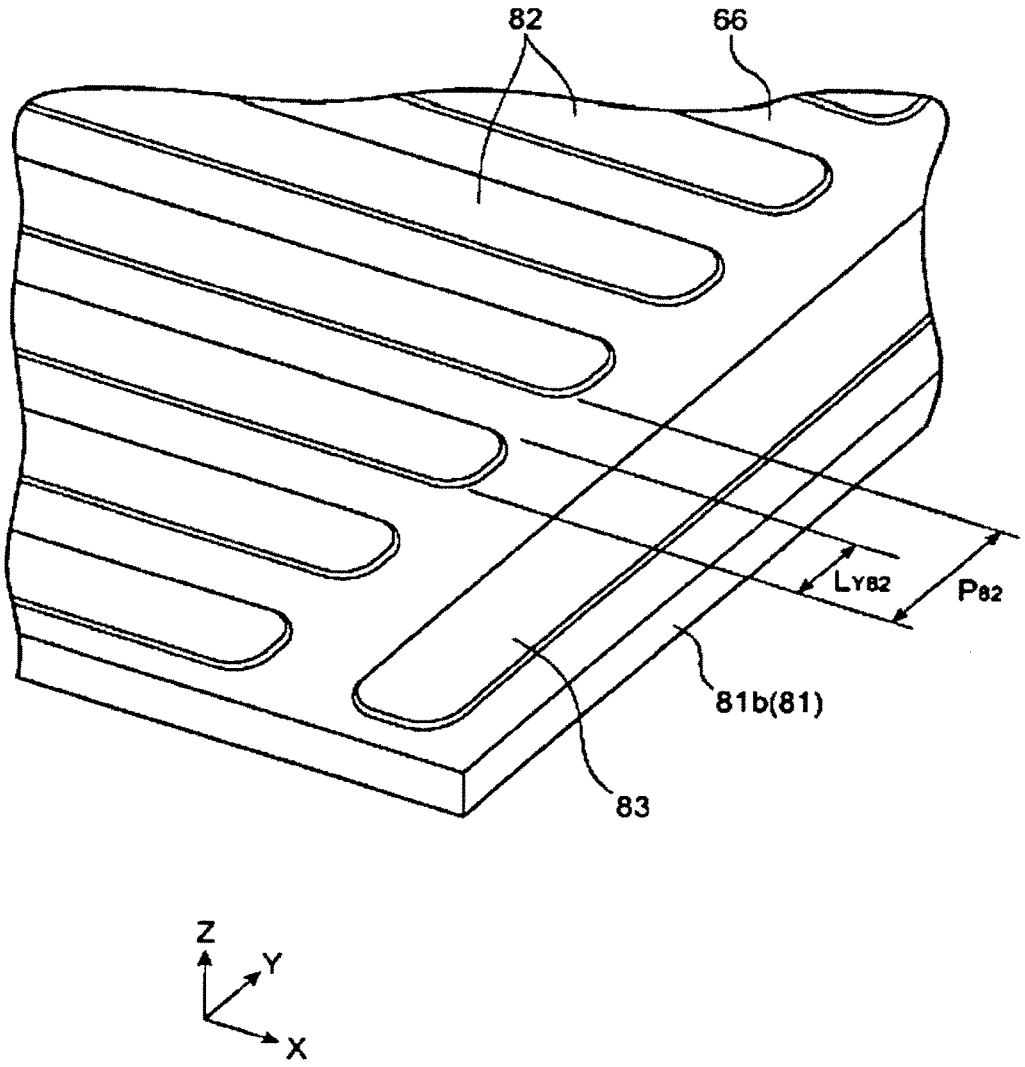
FIG. 6 is an enlarged perspective view of a contact portion of a contact member according to an embodiment.

Protrusions of a fixing sliding member according to a second embodiment will now be explained with reference to FIG. 6. A plurality of protrusions 82 and lubricant supporting protrusions 83 may be disposed on a main body portion (e.g., a contact portion) 81*b* of a fixed sliding member 81 according to the second embodiment. The protrusions 82 may extend in the width direction X of the fixing belt 51 and may be arranged to be spaced apart from one another in the movement direction Y of the fixing belt 51. Also, the lubricant supporting protrusions 83 may extend in the movement direction Y of the fixing belt and may be arranged on both end portions of the fixed sliding member 81 in the width direction X of the fixing belt 51.

The lubricant supporting protrusions 83 may be arranged outside the protrusions 82 in the width direction X of the fixing belt 51. In the fixing device 50 according to an embodiment, a lubricant may be distributed between the main body portion 81*b* of the fixed sliding member 81 and the inner circumferential surface 51*b* of the fixing belt 51. The lubricant supporting protrusions 83 may be lubricant supports for supporting the lubricant distributed between the main body portion 81*b* of the fixed sliding member 81 and the inner circumferential surface 51*b* of the fixing belt 51. The lubricant supporting protrusions 83 may be arranged outside an image forming region of the recording medium P in the width direction X and may be arranged inside a nip load region to which a load is applied by the pressure roller 52. The image forming region of the recording medium P is a region where a toner image may be formed on the recording medium P. The nip load region is a region where the fixing belt 51 and the pressure roller 52 may contact each other.

A width $L_{Y82}$ of each of the protrusions 82 may be, for example, equal to or greater than 0.55 mm. Also, a pitch $P_{82}$ between adjacent protrusions of the protrusions 82 in the movement direction Y of the fixing belt 51 may be, for example, equal to or greater than 1.1 mm. A width of each of the lubricant supporting protrusions 83 may be, for example, equal to or greater than the width $L_{Y82}$ of each of the protrusions 82.

As described above, when the lubricant supporting protrusions 83 having band shapes are arranged on both end portions in the width direction X of the fixing belt 51, a lubricant distributed between the main body portion 65*b* and the inner circumferential surface 51*b* of the fixing belt 51 may have a limited movement in the width direction X of the fixing belt 51. Accordingly, leakage of the lubricant to the outside of the fixing nip portion 53 in the width direction X of the fixing belt 51 may be prevented.

Figure 7A:
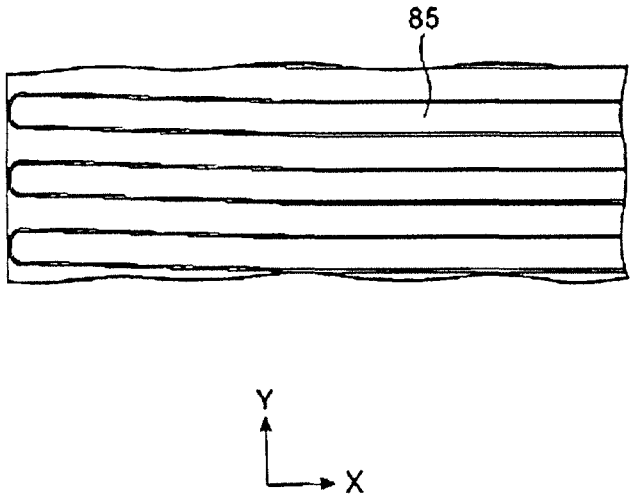
FIGS. 7A through 7C are enlarged plan views of protrusions of the contact portion according to an embodiment.
Figure 7B:
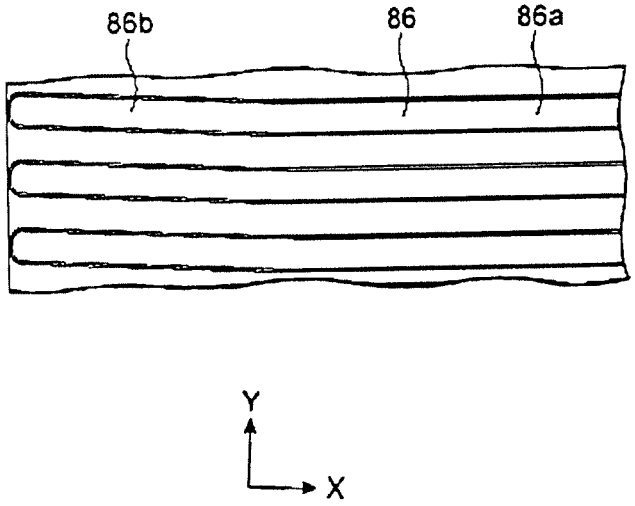
Figure 7C:
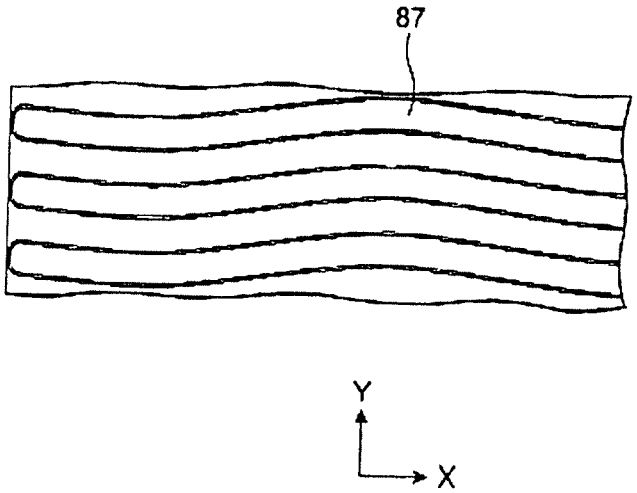

A modification of protrusions having band shapes will now be explained with reference to FIGS. 7A through 7C. Protrusions 85 through 87 having band shapes of FIGS. 7A through 7C are third through fifth modifications of the protrusions 82 having band shapes of FIG. 6. FIGS. 7A through 7C illustrate portions of the protrusions 85 through 87 having band shapes from centers to ends in a longitudinal direction.

As shown in FIG. 7A, the protrusions 85 having band shapes according to the third modification may be inclined so that there is a predetermined angle between an extension direction in which the protrusions 85 extend and the width direction X of the recording medium P. The protrusions 85 having band shapes are not perpendicular to the movement direction Y of the fixing belt 51. The protrusions 85 having band shapes may be arranged to be inclined in a longitudinal direction over the entire length. In this case, an inclination angle of the protrusions 85 having band shapes may be constant or may vary according to positions in the longitudinal direction.

As shown in FIG. 7B, the protrusions 86 having band shapes according to the fourth modification may each include a central portion 86*a* and end portions 86*b* in a longitudinal direction. The central portion 86*a* may have a length that is about ⅓ of an entire length in the longitudinal direction of the protrusions 86. The central portion 86*a* may be disposed to be perpendicular to the movement direction Y of the fixing belt 51. The end portions 86*b* may be disposed at both end portions of the central portion 86*a* to be inclined with respect to the central portion 86*a*. For example, portions of the end portions 86*b* that are close to the central portion 86*a* may be disposed at an inlet of the fixing unit 53, that is, at an upstream of the movement direction Y of the fixing belt 51, and portions of the end portions 86*b* that are far from the central portion 84*a* may be disposed at an outlet of the fixing unit 53, that is, at a downstream of the movement direction Y of the fixing belt 51. Also, in this case, an angle formed between each of the end portions 86*b* and the central portion 86*a* may be, for example, but not limited to, equal to or greater than 5° and equal to or less than 30°.

Also, protrusions having band shapes may be arranged so that portions ranging from a central portion to both end portions are inclined in a longitudinal direction without including a portion of the central portion that is perpendicular to the movement direction Y of the fixing belt. For example, the protrusions may be arranged to have V shapes with a center of an entire length as a vertex. Even in this case, the central portion may be disposed at an inlet of the fixing nip portion 53, that is, at an upstream of the movement direction Y of the fixing belt 51, and outer portions may be disposed at an outlet of the fixing nip portion 53, that is, at a downstream of the movement direction Y of the fixing belt 51.

Also, protrusions having band shapes may include a portion of a central portion perpendicular to the movement direction Y of the fixing belt 51 in a longitudinal direction, and curved portions that are curved outward in the longitudinal direction from the central portion may be disposed at an outlet of the fixing nip portion 53, that is, at a downstream of the movement direction Y of the fixing belt 51.

As shown in FIG. 7C, the protrusions 87 having band shapes according to the fifth modification may be curved to have waveforms. The protrusions 87 may include a plurality of curved portions. In this case, the curved portions that are curved in opposite directions may be alternately arranged in the width direction X of the fixing belt 51. In this case, both outer end portions in a longitudinal direction may be disposed at an outlet of the fixing nip portion 53, that is, at a downstream of the movement direction Y of the fixing belt 51.

Figure 8:
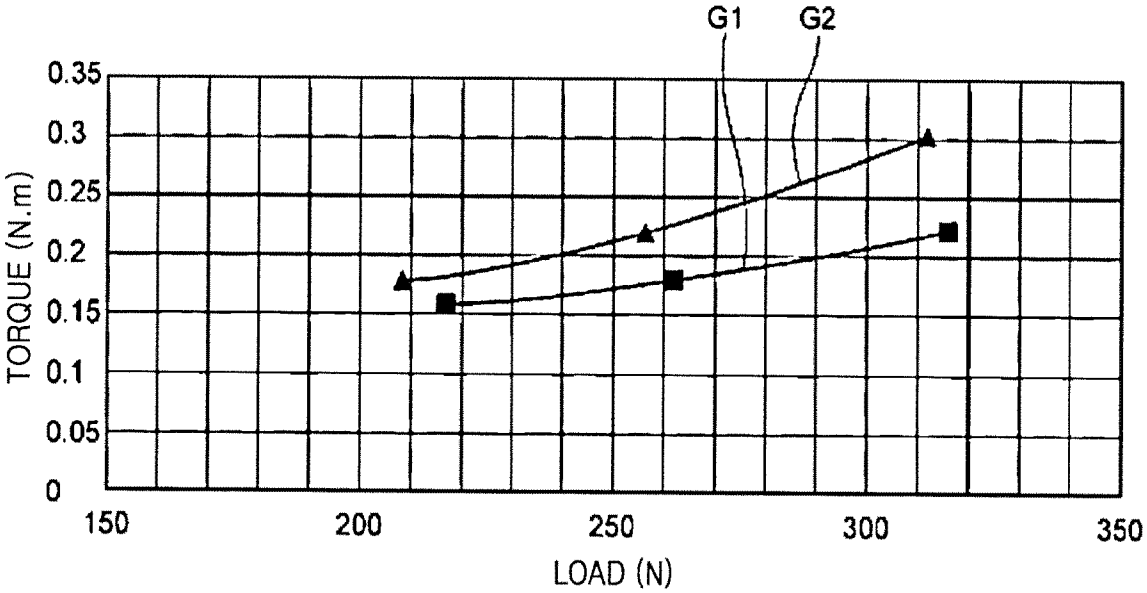
FIG. 8 is a graph illustrating a torque generated when a fixing belt starts to be driven according to an embodiment.

A torque that may be generated when a fixing belt is driven will now be explained with reference to FIG. 8. FIG. 8 is a graph illustrating a torque generated when the fixing belt 51 is driven. The horizontal axis in FIG. 8 represents a load (N) at the fixing nip portion 53 and the vertical axis represents a torque (N·m) that may be generated when the fixing belt 51 is driven.

In Embodiment 1, a fixing device including the fixed sliding member 65 on which the plurality of protrusions 67 having rectangular shape are formed as shown in FIG. 4 is used. In Comparative Example 1, a fixing device including a fixed sliding member having a plate shape on which no protrusions are formed is used. The fixing devices in Embodiment 1 and Comparative Example 1 are the same except for the presence of the protrusions. Next, a maximum value of a torque that may be generated when the fixing belt 51 is driven is measured and is plotted on a graph.

In Embodiment 1 and Comparative Example 1, a torque is measured a plurality of times by changing a load of the fixing nip portion 53. In FIG. 8, a graph G1 corresponds to a measurement result of Embodiment 1 and a graph G2 corresponds to a measurement result of Comparative Example 1. For example, it is found that when a load is about 300 N, a torque of Embodiment 1 is 30% or more less than a torque of Comparative Example 1.

Figure 9:
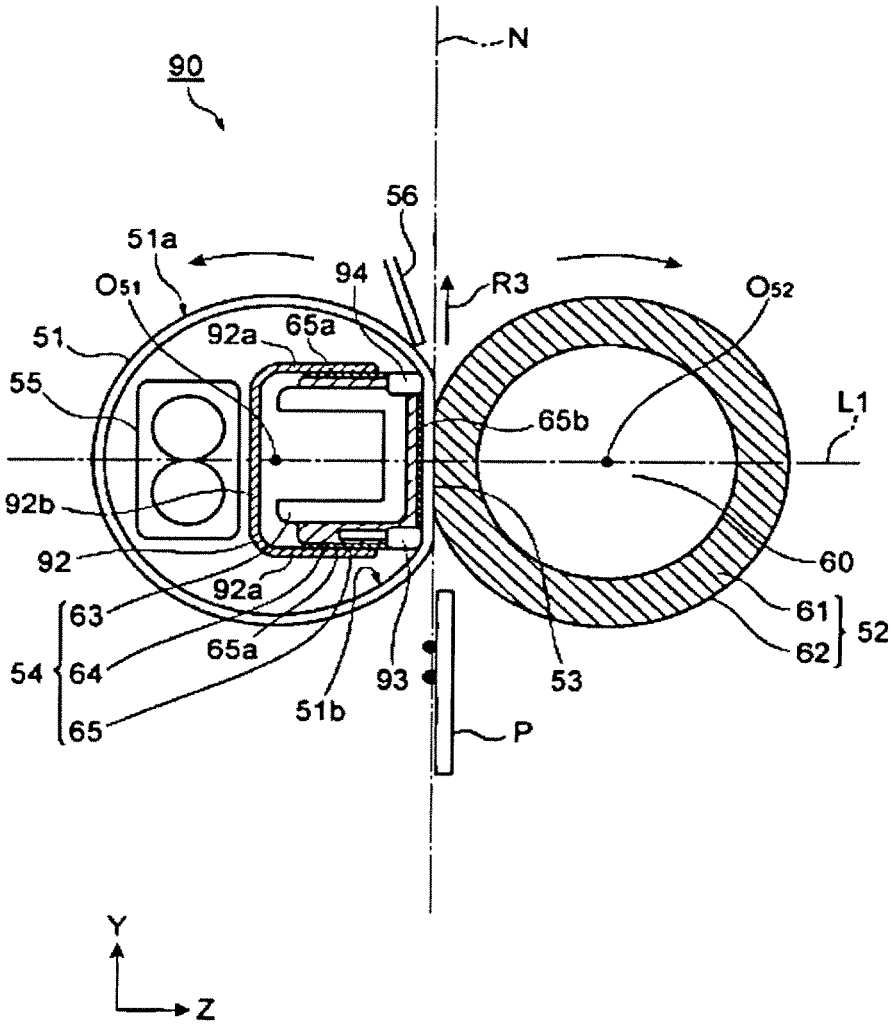
FIG. 9 is a cross-sectional view of a fixing device according to an embodiment.

A fixing device 90 according to a third embodiment will now be explained with reference to FIG. 9. When the fixing device 90 according to the third embodiment is described, the same elements or structures as those in the first and second embodiments will not be explained.

The fixing device 90 may include the fixing belt 51, the pressure roller 52, the contact member 54, and the heat source (e.g., heater) 55. Also, the fixing device 90 may include the separation member 56 that separates the recording medium P attached to the outer circumferential surface 51*a* of the fixing belt 51 from the fixing belt 51. The separation member 56 may be disposed at an outlet of the fixing nip portion 53 in the feeding direction R3 of the recording medium P.

The contact member 54 may be disposed inside the fixing belt 51 and may apply a pressure to the recording medium P along with the pressure roller 52. The contact member 54 may extend in an axial direction of the fixing belt 51 having a cylindrical shape, and may include the structure 63 that extends in the axial direction, the support 64 that is supported on the structure 63, and the fixed sliding member 65 that is supported by the support 64. The fixed sliding member 65 may include the plurality of protrusions 67.

Also, the fixing device 90 may include a reflecting plate 92 that covers an outer surface of the contact member 54. The reflecting plate 92 may extend in the axial direction of the fixing belt 51, and a cross-section of the reflecting plate 92 taken in a direction perpendicular to a longitudinal direction may have a "⊏" shape. The reflecting plate 92 may include one pair of side walls 92*a* that extend in a direction perpendicular to a feeding direction of the recording medium P, and a connection portion 92*b* that connects end portions of the one pair of side walls 92*a*. In FIG. 9, end portions of the one pair of side walls 92*a* (specifically that are close to the heat source 55) may be connected to each other by the connection portion 92*b*.

The one pair of side walls 92*a* may be mounted to cover the one pair of side walls 65*a* of the fixed sliding member 65. The reflecting plate 92 may reflect radiant heat applied from the heat source 55 to the inner circumferential surface 51*b* of the fixing belt 51. Also, the reflecting plate 92 may reflect radiant heat applied from the inner circumferential surface 51*b* of the fixing belt 51 to the inner circumferential surface 51*b* of the fixing belt 51.

Also, the fixing device 90 may further include a lubricant supply portion 93 that is disposed at an upstream of the main body portion 65*b* that is a contact portion of the fixed sliding member 65, that is, at an inlet of the fixing hip portion 53 and a film thickness regulating portion 94 that is disposed at a downstream of the main body portion 65*b*, that is, at an outlet of the fixing nip portion 53, in the movement direction Y of the fixing belt 51.

The lubricant supply portion 93 may be disposed at end portion of the upstream of the main body portion 65*b* of the fixed sliding member 65, that is, at the inlet of the fixing nip portion 53, in the movement direction Y of the fixing belt 51, and may be supported on the fixed sliding member 65. The lubricant supply portion 93 may have a length corresponding to a width of the fixing belt 51 in the axial direction of the fixing belt 51. A lubricant may be filled in the lubricant supply portion 93, and part of the lubricant leaching out of the lubricant supply portion 93 may be applied to the inner circumferential surface 51*b* of the fixing belt 51. Also, the lubricant attached to the inner circumferential surface 51*b* may be moved as the fixing belt 51 moves and may be supplied between the main body portion 63*b* and the inner circumferential surface 51*b*.

The film thickness regulating portion 94 may be disposed at end portion of the downstream of the main body portion 65*b* of the fixed sliding member 65, that is, at the outlet of the fixing nip portion 53, in the movement direction Y of the fixing belt 51 and may be supported by the support 64. The film thickness regulating portion 94 may have a length corresponding to a width of the fixing belt 51 in the axial direction of the fixing belt 51.

Also, when the film thickness regulating portion 94 may contact the inner circumferential surface 51*b* of the fixing belt 51 and may regulate a shape of the fixing belt 51 when the fixing belt 51 rotates. The film thickness regulating portion 94 may extend in a diameter direction of the fixing belt 51 to protrude outward, and may be disposed to press the inner circumferential surface 51*b*. Also, the film thickness regulating portion 94 may regulate a film thickness of a lubricant passing through the main portion 65*b* and moved to the outlet of the fixing nip portion 53. That is, the lubricant attached to the inner circumferential surface 51*b* of the fixing belt 51 may have a limited movement to the outlet of the fixing nip portion 53 due to the film thickness regulating portion 94.

The film thickness regulating portion 94 may include a nonwoven fabric. The nonwoven fabric may include, for example, a heat-resistant fiber. The nonwoven fabric may have heat resistance of, for example, 300° C. or more. Also, the nonwoven fabric may have flame resistance as well as heat resistance, and a UL94 flammability rating of the nonwoven fabric may be equal to or greater than V-0. Also, a thickness of the nonwoven fabric may be, for example, equal to or greater than 0.8 mm and equal to or less than 4.5 mm. Also, a weight of the nonwoven fabric may be, for example, equal to or greater than 200 g/m$^2$. Also, an Aramid fiber that is a heat-resistant fiber may be included in the nonwoven fabric.

For example, the film thickness regulating portion 94 may be formed by winding the nonwoven fabric around a member having a bar shape. Also, the film thickness regulating portion 94 may be formed by stacking a plurality of layers formed of the nonwoven fabric. Also, the film thickness regulating portion 94 may be formed of a material such as a synthetic resin.

In the fixing device 90 according to an embodiment, a lubricant may be supplied from the upstream of the fixed sliding member 65, that is, from the inlet of the fixing nip portion 53, and may be distributed between the main body portion 65*b* of the fixed sliding member 65 and the inner circumferential surface 51*b* of the fixing belt 51. Accordingly, frictional resistance between the main body portion 65*b* of the fixed sliding member 65 and the inner circumferential surface 51*b* of the fixing belt 51 may be reduced, an increase in torque of the fixing belt 51 may be prevented, and a torque may be reduced even when the fixing device 90 starts to be driven or is driven.

In the fixing device 90 according to an embodiment, since a lubricant may be distributed between the main body portion 65*b* of the fixed sliding member 65 and the inner circumferential surface 51*b* of the fixing belt 51, when compared to a case where no lubricant is distributed, friction dust produced due to friction between the fixed sliding member 65 and the fixing belt 51 may be prevented, and thus contamination due to the friction dust may be prevented. For example, although a surface layer formed on the inner circumferential surface 51*b* of the fixing belt 51 is detached and thus wear dust may be produced, the fixing device 90 according to an embodiment may prevent friction dust from being produced because a lubricant is distributed as described above. Accordingly, the amount of friction dust moved to the outlet of the fixing nip portion 53 along with a remaining lubricant may be reduced, and thus contamination of the inside of the fixing belt 51 may be prevented.

Also, in the fixing device 90 according to an embodiment, a film thickness of a lubricant attached to the inner circumferential surface 51*b* of the fixing belt 51 may be regulated by the film thickness regulating portion 94. A lubricant having a thickness equal to or greater than a predetermined thickness may contact the film thickness regulating portion 94, and thus may not move to the outlet of the fixing unit 53. The film thickness regulating portion 94 may include a nonwoven fabric, and a remaining lubricant attached to the inner circumferential surface 51*b* of the fixing belt 51 may be removed by the nonwoven fabric. Also, a small amount of wear dust, which may be produced due to friction between the fixed sliding member 65 and the fixing belt 51 may also be removed along with the remaining lubricant by the nonwoven fabric included in the film thickness regulating portion 94.

As the remaining lubricant and the wear dust are removed as described above, contamination due to the remaining lubricant and the wear dust may be prevented. Accordingly, since the remaining lubricant and the wear dust are prevented from being attached to the inner circumferential surface 51*b* of the fixing belt 51, the remaining lubricant and the wear dust may be prevented from dropping from the inner circumferential surface 51*b* of the fixing belt 51. Also, the amount of the remaining lubricant and the wear dust attached to the reflecting plate 92 may be reduced, and thus reflection efficiency may be prevented from being reduced. As a result, since radiant heat from the heat source 55 may be efficiently transmitted to the fixing belt 51, the fixing belt 51 may be more efficiently heated and a toner image may be more reliably fixed onto the recording medium P.

Also, in the fixing device 90 according to an embodiment, since the film thickness regulating portion 94 contacts the inner circumferential surface 51*b* of the fixing belt 51, a shape of the fixing belt 51 that rotates may be defined. The fixing belt 51 may receive an external pressure in the diameter direction due to the film thickness regulating portion 94, and thus a shape of the fixing belt 51 may be defined. Accordingly, a rotational displacement of the fixing belt 51 may be defined. The rotational displacement refers to a displacement of the fixing belt 51 which may occur when the fixing belt 51 rotates, and especially refers to a displacement in a thickness direction of the fixing belt 51. In the fixing device 90 according to an embodiment, since a rotational displacement of the fixing belt 51 may be defined, unnecessary contact between the fixing belt 51 and the separation member 56 that is disposed close to the outer circumferential surface 51*a* of the fixing belt 51 may be prevented. Also, since a rotational shape (e.g., an orbit) of the fixing belt 51 may be stabilized, abrupt contact between the fixing belt 51 and the separation member 56 may be prevented.

Also, in the fixing device 90 according to an embodiment, since a rotational shape of the fixing belt 51 that is disposed near the outlet of the fixing nip portion 53 may be more stably defined, a front end portion of the separation member 56 may be disposed to be closer to the outer circumferential surface 51*a* of the fixing belt 51. Accordingly, the recording medium P attached to the outer circumferential surface 51*a* of the fixing belt 51 may be more reliably separated.

Also, since the film thickness regulating portion 94 may prevent a remaining lubricant and wear dust attached to the fixing belt 51 from passing through the film thickness regulating portion 94 and moved to the outlet of the fixing nip portion 53 and may more stably regulate a rotational shape of the fixing belt 51, an additional structure may not need to be provided and thus a structure of the fixing device 90 may be simplified.

Figure 10:
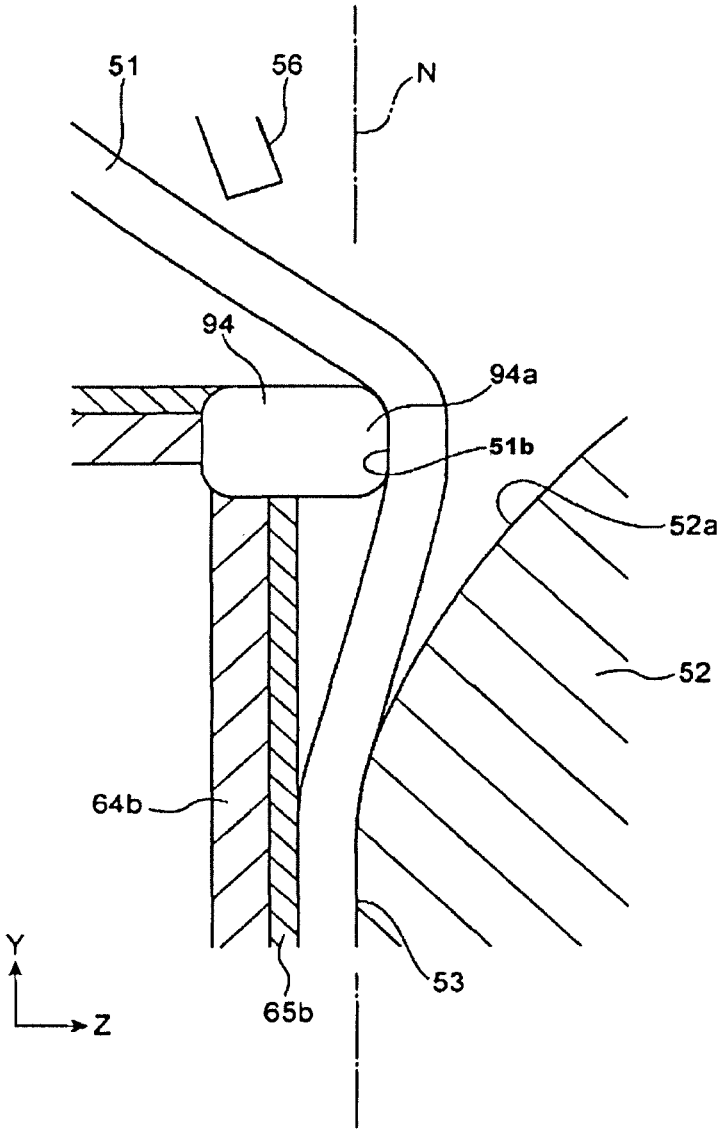
FIG. 10 is an enlarged cross-sectional view of a film thickness regulating portion according to an embodiment.

FIG. 10 is an enlarged cross-sectional view illustrating a modification of the film thickness regulating portion 94. The film thickness regulating portion 94 may include a regulating portion 94*a* that protrudes toward the fixing belt 51 as shown in FIG. 10. The regulating portion 94*a* that is a shape regulating portion having a surface facing the inner circumferential surface 51*b* of the fixing belt 51 may protrude outward in the diameter direction of the fixing belt 51 according to an embodiment. The regulating portion 94*a* may protrude toward the pressure roller 52 beyond the main body portion 65*b* of the fixed sliding member 65. Also, the regulating portion 94*a* according to an embodiment may protrude toward the pressure roller 52 beyond the nip surface N. Accordingly, a contact position between the regulating portion 94*a* and the fixing belt 51 may be outside the nip surface N in the diameter direction. When the regulating portion 94*a* protrudes outward beyond the nip surface N as described above, the film thickness regulating portion 94 may more stably contact the fixing belt 51 and may more surely define a rotational displacement of the fixing belt 51. Also, a remaining lubricant and wear dust that may be attached to the inner circumferential surface 51*b* of the fixing belt 51 may be more reliably reduced.

Figure 11:
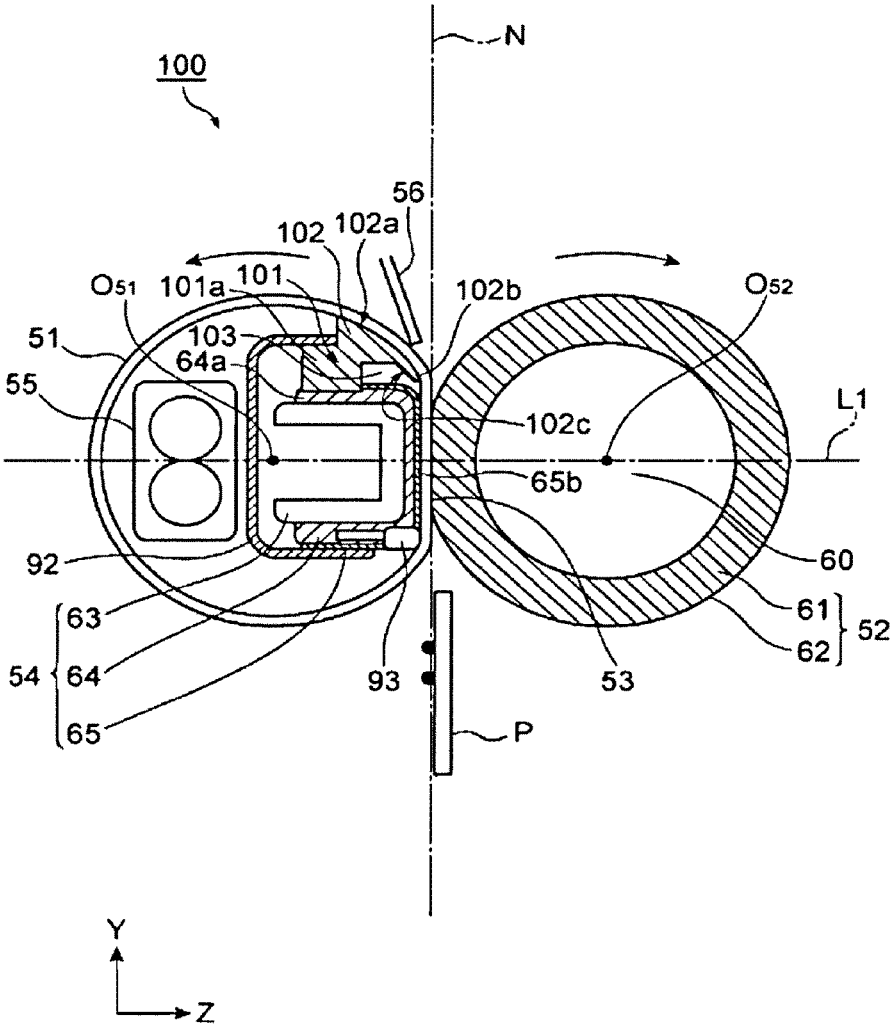
FIG. 11 is a cross-sectional view of a fixing device according to an embodiment.

A fixing device 100 according to a fourth embodiment will now be explained with reference to FIG. 11. The fixing device 100 of FIG. 11 is different from the fixing device 90 according to the third embodiment in that a structure of a film thickness regulating portion 102 is different from that of the film thickness regulating portion 94 and a lubricant receiving portion 103 for receiving a lubricant retrieved from the film thickness regulating portion 102 is provided. When the fixing device 100 of the fourth embodiment is described, the same elements or structures as those in the first through third embodiments will not be explained.

The fixing device 100 according to an embodiment may include a film thickness regulating member 101 including the film thickness regulating portion 102. The film thickness regulating member 101 may extend in an axial direction of the fixing belt 51. In this case, the film thickness regulating member 101 may have a length corresponding to a width of the fixing belt 51 in the axial direction of the fixing belt 51. The film thickness regulating member 101 may include a support 101*a* in addition to the film thickness regulating portion 102. The support 101*a* may be disposed to be supported on the contact member 54.

The support 101*a* may be formed to have, for example, a pillar shape, and may extend in the axial direction of the fixing belt 51. The support 101*a* may be disposed to be supported on, for example, a side wall 64*a* at a downstream (e.g., at a downstream of the movement direction Y of the fixing belt 51) of the support 64. However, embodiments are not limited thereto, and the support 101*a* may be disposed to be supported on the structure 63 of the contact member 54.

The film thickness regulating portion 102 may be disposed to be supported by the support 101*a* (e.g., the film thickness regulating portion 102 may be integrally formed with the support 101*a*). The film thickness regulating portion 102 may include a guide surface 102*a*, an edge portion 102*b*, and an inclined surface 102*c*. The film thickness regulating portion 102 may protrude outward from the support 101*a* in a diameter direction of the fixing belt 51. The film thickness regulating portion 102 may include the guide surface 102*a* that contacts the inner circumferential surface 51*b* of the fixing belt 51. For example, the guide surface 102*a* may extend in a circumferential direction about the center of rotation $O_{51}$ of the fixing belt 51. Also, the guide surface 102*a* may have a predetermined length in the circumferential direction of the fixing belt 51. For example, a length of the guide surface 102*a* may be 10% of a length of a circumference of the fixing belt 51.

Also, the guide surface 102*a* may include, for example, a synthetic resin. The guide surface 102*a* may include a synthetic resin having high heat resistance and high flame resistance, for example, PPS, polyethylene terephthalate (PET), LCP, or PEEK. Also, the guide surface 102*a* may include a nonwoven fabric.

Figure 12:
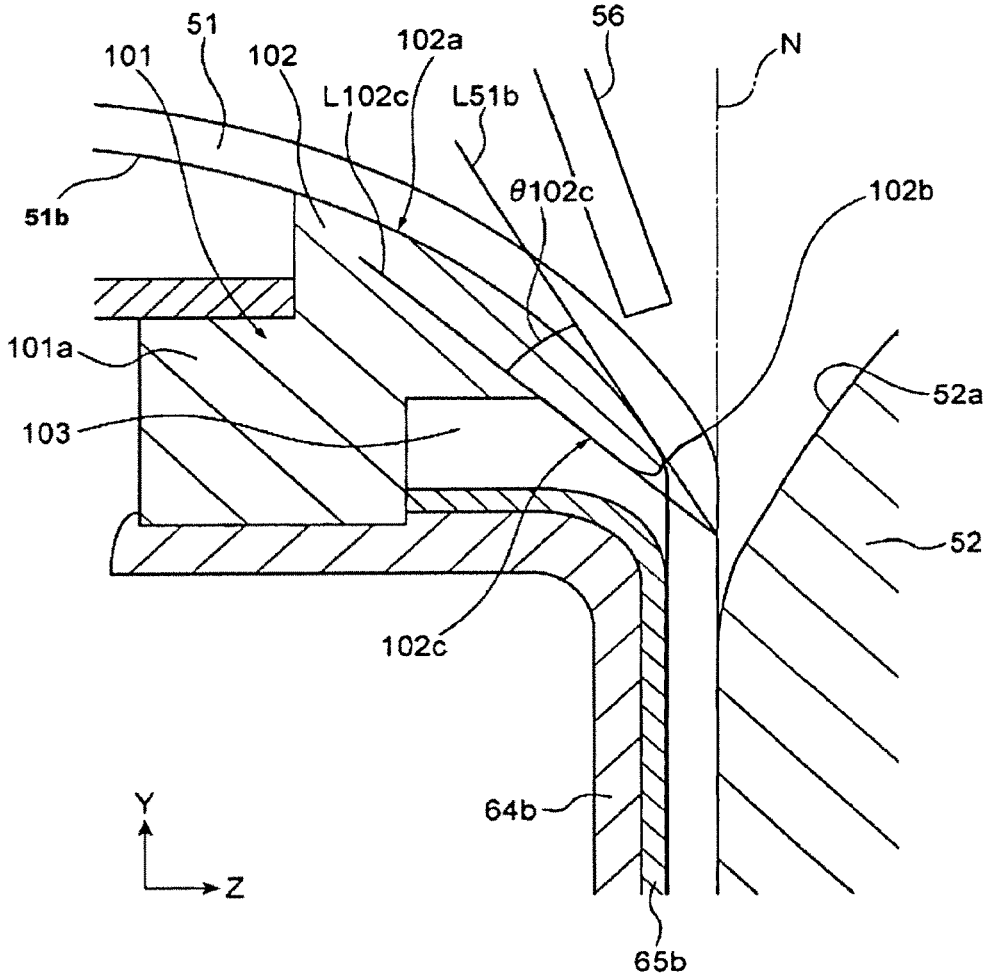
FIG. 12 is an enlarged cross-sectional view of an edge portion of a film thickness regulating member according to an embodiment.

FIG. 12 is an enlarged cross-sectional view of the edge portion 102*b* of the film thickness regulating member 101. As shown in FIG. 12, the edge portion 102*b* that is an end portion of the guide surface 102*a* may be disposed between a front end portion of the separation member 56 and the main body portion 65*b* of the fixed sliding member 65.

One surface of the edge portion 102*b* that faces the center of rotation $O_{51}$ of the fixing belt 51 may be the inclined surface 102*c* that is inclined with respect to a tangent line L51*b* that contacts the inner circumferential surface 51*b* of the fixing belt 51. An inclination angle $\theta_{102c}$ of a straight line L102*c* that follows the inclined surface 102*c* and the tangent line L51*b* may be, for example, but not limited to, equal to or greater than 15° and equal to or less than 45°.

The fixing device 100 may include the lubricant receiving portion 103 that receives a lubricant retrieved from the film thickness regulating portion 102. The lubricant receiving portion 103 may be disposed at a downstream of the fixed sliding member 65, that is, at an outlet of the fixing nip portion 53, and may be disposed at a further upstream than the edge portion 102*b*, in the movement direction Y of the fixing belt 51. The lubricant receiving portion 103 may include an opening close to the inner circumferential surface 51*b* of the fixing belt 51.

The lubricant receiving portion 103 may receive a remaining lubricant in a space formed between the side wall 65*a* (see FIG. 1) of the fixed sliding member 65 and the film thickness regulating portion 102. A lubricant moved after being attached to the fixing belt 51 may reach the edge portion 102*b* of the film thickness regulating portion 102 and may be separated from the fixing belt 51. The separated lubricant may be received in the lubricant receiving portion 103 after being moved along the inclined surface 102*c* of the edge portion 102*b*.

Contamination due to the remaining lubricant and wear dust may be prevented due to the fixing device 100 of the fourth embodiment.

Also, in the fixing device 100 of the fourth embodiment, although the film thickness regulating member 101 and the support 64 are separate elements, the film thickness regulating member 101 and the support 64 may be integrated as one member. Accordingly, the number of parts in the fixing device 100 may be reduced and a structure of the fixing device 100 may be simplified.

Embodiments are not limited thereto and various modifications may be made without departing from the scope of the inventive concept.

In the fixing device 100, the fixing belt 51 may include the base portion 57 formed of a synthetic resin, and the lubricant supply portion 93 may supply a black lubricant. Accordingly, the black lubricant may be applied to the inner circumferential surface 51*b* of the fixing belt 51. When the fixing belt 51 is formed of a synthetic resin that does not allow for black surface treatment, an absorbance of radiant heat of the fixing belt 51 may be increased by applying a black lubricant to the inner circumferential surface 51*b* of the fixing belt 51. Accordingly, heating efficiency may be improved and an image may be stably fixed onto the recording medium by using the fixing device 100. The black lubricant may be a fluorine-based lubricant to which carbon black or black dye is added. However, embodiments are not limited thereto, and a lubricant may be black by using other methods.

Also, in the embodiments, protrusions may be included in the main body portion 65*b* that is a contact portion of the fixed sliding member 65, or may not be included in the main body portion 65*b* of the fixing device 90 or 100 of the third or fourth embodiment.

Also, shapes of the protrusions are not limited to diamond shapes, circular shapes, and band shapes, and may be any of other shapes such as trapezoidal shapes or elliptical shapes.

Also, a pitch between the plurality of protrusions is not limited to 1.1 mm or more, and may be less than 1.1 mm. Also, the pitch between the protrusions may be constant or may vary according to positions, for example, in the width direction X. Also, a length of each of the protrusions contacting the fixing belt is not limited to 0.5 mm or more, and may be less than 0.55 mm.

According to an embodiment, there may be provided a fixing device that may prevent an increase in torque which may be generated when a fixing belt starts to be driven and an image forming apparatus including the fixing device.

While one or more embodiments have been described with reference to the figures, it will be understood by those of ordinary skill in the art that various changes in form and details may be made therein without departing from the spirit and scope as defined by the following claims.

What is claimed is:

1. A fixing device through which a recording medium, on which an electrical toner image is recordable, passes through, comprising:

a fixing belt that is rotatable in a movement direction of the recording medium and includes an inner circumferential surface and an outer circumferential surface;

a pressure roller to pressure-contact the outer circumferential surface of the fixing belt and to form a fixing nip portion between the pressure roller and the fixing belt to pass through the recording medium through the fixing nip portion in the movement direction of the fixing belt; and a contact member located inside the fixing belt and including a contact portion to contact the inner circumferential surface of the fixing belt, wherein the contact portion includes a surface that faces the pressure roller, the surface including, a plurality of protrusions that protrude from the surface toward the pressure roller, and at least one lubricant supporting protrusion that protrudes from the surface toward the pressure roller and disposed in the movement direction of the fixing belt to support distribution of a lubricant between the surface and the inner circumferential surface of the fixing belt.

2. The fixing device of claim 1, wherein the plurality of protrusions form a first row of protrusions arranged in a width direction of the fixing belt and spaced apart from one another, and a second row of protrusions, which is spaced apart from the first row in the movement direction, arranged in the width direction of the fixing belt and spaced apart from one another, so that the first row of protrusions are alternately arranged with respect to the second row of protrusions in the movement direction.

3. The fixing device of claim 2, wherein a length of a protrusion among the plurality of protrusions in a width direction of the fixing belt is approximately equal to or greater than a distance between adjacent protrusions of the plurality of protrusions in the width direction of the fixing belt.

4. The fixing device of claim 3, wherein a length of a protrusion among the plurality of protrusions in the width direction of the fixing belt is approximately equal to or greater than 0.55 mm, and a pitch between adjacent protrusions of the plurality of protrusions in the width direction of the fixing belt is approximately equal to or greater than 1.1 mm.

5. The fixing device of claim 1, wherein the plurality of protrusions form band shapes that extend in a width direction of the fixing belt.

6. The fixing device of claim 5, wherein the plurality of protrusions has a portion that is inclined at an angle with respect to the width direction of the fixing belt.

7. The fixing device of claim 1, wherein the at least one lubricant supporting is arranged on both end portions of the fixing belt in a width direction of the fixing belt.

8. The fixing device of claim 7, wherein the at least one lubricant supporting protrusion is arranged outside an image forming region of the recording medium where the electrical toner image is formed in the width direction of the fixing belt and inside the fixing nip portion.

9. The fixing device of claim 1, wherein the contact portion comprises a base portion and the surface of the contact portion is a surface layer stacked on the base portion, at least a part of the base portion comprises at least any one or combinations of aluminum, stainless, liquid crystal polymer (LCP), and polyphenylene sulfide (PPS), and at least a part of the surface layer comprises at least any one of or combinations polytetrafluoroethylene (PTFE), perfluoroalkoxy (PFA) fluorine synthetic resin, and a modifier thereof.

10. The fixing device of claim 1, wherein the contact portion comprises a base portion, the surface of the contact portion is a surface layer having a plate shape, and the base portion has a plate shape corresponding to the plate shape of the surface layer, and the base portion comprises aluminum and has a thickness that is approximately equal to or greater than 0.2 mm and approximately equal to or less than 0.5 mm.

11. The fixing device of claim 1, wherein the contact portion comprises a base portion, the surface of the contact portion is a surface layer having a plate shape, and the base portion has a plate shape corresponding to the plate shape of the surface layer, and the base portion comprises stainless and has a thickness that is approximately equal to or greater than 0.1 mm and approximately equal to or less than 0.3 mm.

12. The fixing device of claim 1, further comprising:

a lubricant supply portion located at an inlet of the fixing nip portion through which the fixing belt is introduced to supply a lubricant to the contact portion; and a film thickness regulating portion located at an outlet of the fixing nip portion through which the fixing belt is discharged to define a shape of the fixing belt in response to rotation of the fixing belt by contacting the inner circumferential surface of the fixing belt and to regulate a film thickness of the lubricant by being attached to the inner circumferential surface of the fixing belt.

13. The fixing device of claim 12, wherein the film thickness regulating portion comprises a regulating portion that extends in a diameter direction of the fixing belt, the regulating portion protrudes outward in the diameter direction of the fixing belt beyond a nip surface of the fixing nip portion on which the pressure roller and the outer circumferential surface of the fixing belt contact each other.

14. The fixing device of claim 13, further comprising a separation member to separate the recording medium attached to the outer circumferential surface of the fixing belt, wherein the separation member is located at an outlet of the fixing nip portion through which the fixing belt is discharged and the regulating portion is located between the contact member and the separation member.

15. The fixing device of claim 12, wherein the film thickness regulating portion comprises a guide surface that contacts the inner circumferential surface of the fixing belt, and the guide surface extends in a circumferential direction of the fixing belt.

16. The fixing device of claim 15, wherein the film thickness regulating portion comprises an edge portion that is located on an end portion of the guide surface to scrape the lubricant attached to the inner circumferential surface of the fixing belt, and a lubricant receiving portion that is located between the contact member and the edge portion to receive the lubricant scraped by the edge portion.

17. The fixing device of claim 16, wherein the edge portion comprises an inclined surface that is inclined at an angle with respect to a tangent line that contacts the inner circumferential surface of the fixing belt.

18. The fixing device of claim 17, further comprising a separation member to separate the recording medium attached to the outer circumferential surface of the fixing belt, wherein the separation member is located at an outlet of the fixing nip portion through which the fixing belt is discharged and the edge portion is located between the contact member and the separation member.

19. An image forming apparatus comprising the fixing device of claim 1.

* * * * *